US009098027B2

(12) United States Patent
Hasegawa

(10) Patent No.: US 9,098,027 B2
(45) Date of Patent: Aug. 4, 2015

(54) IMAGE HEATING APPARATUS WITH MOVABLE RUBBING MEMBER RUBBING A HEATING ROTATING BODY

(71) Applicant: CANON KABUSHIKI KAISHA, Tokyo (JP)

(72) Inventor: Kazuhiro Hasegawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 198 days.

(21) Appl. No.: 13/675,473

(22) Filed: Nov. 13, 2012

(65) Prior Publication Data

US 2013/0136480 A1 May 30, 2013

(30) Foreign Application Priority Data

Nov. 24, 2011 (JP) ..... 2011-256008

(51) Int. Cl.
*G03G 15/20* (2006.01)

(52) U.S. Cl.
CPC ..... *G03G 15/2039* (2013.01); *G03G 15/2042* (2013.01)

(58) Field of Classification Search
CPC ..... G03G 15/2032; G03G 15/2064; G03G 15/2078; G03G 15/20; G03G 15/2039; H03B 1/00
USPC ..... 399/69, 71, 94, 122, 326–330
See application file for complete search history.

(56) References Cited

U.S. PATENT DOCUMENTS 5,678,134 A * 10/1997 Miki et al. ..... 399/71
7,200,354 B2 4/2007 Nakamoto et al.
7,406,288 B2 7/2008 Nakamoto et al.
7,430,392 B2 9/2008 Ito et al.
7,457,576 B2 11/2008 Takada et al.
7,466,950 B2 12/2008 Matsuura et al.
7,542,711 B2 6/2009 Nakamoto et al.
7,596,348 B2 9/2009 Nakamoto et al.
7,756,458 B2 * 7/2010 Viney et al. ..... 399/327
7,792,477 B2 9/2010 Nakamoto et al.
7,844,208 B2 11/2010 Hayashi et al.
8,254,802 B2 8/2012 Hanashi et al.
8,391,738 B2 3/2013 Hasegawa
2006/0210293 A1 * 9/2006 Sone et al. ..... 399/69

(Continued)

FOREIGN PATENT DOCUMENTS

JP 10-111622 A 4/1998
JP 2006-215410 A 8/2006
JP 2007-079033 A 3/2007

(Continued)

*Primary Examiner* — Benjamin Schmitt
*Assistant Examiner* — Matthew Miller
(74) *Attorney, Agent, or Firm* — Fitzpatrick, Cella, Haper & Scinto

(57) ABSTRACT

In an image heating apparatus in which a heating rotating body heats a recording material bearing an image and a rubbing member rubs the heating rotating body to eliminate gloss streaks, an image failure, such as gloss unevenness, does not occur on normal plain paper and coated paper, and a toner gloss on the coated paper can be enhanced. A longitudinal temperature difference of a heating rotating body 91 is controlled within a predetermined temperature, so that the surface of the heating rotating body can be uniformly roughed. Consequently, an image failure due to scuffs on the surface of the heating rotating body and gloss unevenness due to unevenness of roughness of the surface of the heating rotating body are prevented, and thus a good fixed image can be obtained.

20 Claims, 8 Drawing Sheets

(56) References Cited

U.S. PATENT DOCUMENTS

2007/0059021 A1 3/2007 Hanashi et al.
2007/0098420 A1* 5/2007 Ohba ..... 399/44
2008/0038027 A1* 2/2008 Ito et al. ..... 399/328
2010/0150625 A1* 6/2010 Sone et al. ..... 399/329

FOREIGN PATENT DOCUMENTS

JP 2008-040363 A 2/2008

* cited by examiner

IMAGE HEATING APPARATUS WITH MOVABLE RUBBING MEMBER RUBBING A HEATING ROTATING BODY

BACKGROUND OF THE INVENTION

1. Field of the Invention

The present invention relates to an image heating apparatus heating a toner image on a recording material, and more particularly to an image heating apparatus provided with a rubbing rotating body which rubs a heating rotating body heating the toner image on the recording material. The image heating apparatus is used in an image forming apparatus such as a copier, a printer, a facsimile machine, and a complex machine having the functions thereof.

2. Description of the Related Art

Conventionally, in an image forming apparatus utilizing an electrophotographic system or the like, a toner image formed on a recording material is pressurized and heated at a nip portion between a heating rotating body and a nip forming member. A material, such as fluororesin, having an excellent releasing property, is used for a surface of the heating rotating body.

Among recording materials, there is a recording material having a protrusion called an "edge protrusion", which is formed at an edge of the recording material. When the recording material passes through a nip, a fine scuff may be formed on a heating rotating body by the edge of the recording material. Since portions through which the edge of the recording material passes are concentrated in a width direction perpendicular to a direction of conveying the recording material, the fine scuffs due to the edge protrusion may be locally formed. Consequently, streaks b (see, FIG. 5) are formed on an image.

As measures against the scuffs due to the edge protrusion, Japanese Patent Application Laid-Open No. 2008-40363 discloses a method of rubbing the heating rotating body with rubbing member. The rubbing member uniformly rubs the heating rotating body, and therefore the fine scuffs concentrated in two portions in a conveyance width direction of the heating rotating body become unnoticeable. In order to prevent a surface of the rubbing member from being contaminated, the rubbing member is usually spaced apart from a heating member, and, in order to rub the surface of the heating rotating body every time a predetermined number of images are formed, the operation of bringing the rubbing member into abutment against the heating rotating body is performed.

However, the viscosity of fluororesin tends to decrease as the temperature increases (FIG. 7). Thus, the depth of a recess of a heating rotating body formed by the rubbing member depends on the surface temperature of the heating rotating body. When the rubbing member rubs the heating rotating body when a temperature difference between a central portion and an end portion in the width direction of the heating rotating body is large, the rubbing by the rubbing member may become nonuniform due to the difference of the viscosity of the fluororesin of the surface of the heating rotating body.

SUMMARY OF THE INVENTION

An object of the present invention is to, in an image heating apparatus provided with a rubbing member rubbing a heating rotating body, suppress nonuniformity of rubbing of a heating rotating body by the rubbing member even though temperature unevenness occurs in the heating rotating body in order to suppress the occurrence of gloss unevenness of an image due to an edge scuff.

Another object of the present invention is to provide an image heating apparatus including: a heating rotating body heating a toner image on a recording material at a nip portion; a rubbing member rubbing the heating rotating body; a moving mechanism moving the rubbing member from a position where the rubbing member is spaced apart from a surface of the heating rotating body to a position where the rubbing member rubs the heating rotating body; a first temperature sensor detecting the temperature of a first region of the heating rotating body through which the recording material having a conveyable minimum width in a width direction of the heating rotating body passes; a second temperature sensor detecting the temperature of a second region of the heating rotating body which is provided outside the first region of the heating rotating body and through which the recording material having a conveyable maximum size in the width direction of the heating rotating body passes; and a controller executing an operation of moving the rubbing member to the position where the rubbing member rubs the heating rotating body when the number of the recording materials with a predetermined width conveyed to the nip portion reaches a predetermined number, and when the difference between the temperature detected by the first temperature sensor and the temperature detected by the second temperature sensor is more than a predetermined value in a case that the number of the recording materials with the predetermined width conveyed to the nip portion reaches the predetermined number, the controller executing the operation with a delay until the difference becomes equal to or less than a predetermined value.

Still another object of the present invention is to provide an image heating apparatus including: a heating rotating body heating a toner image on a recording material at a nip portion; a rubbing member rubbing the heating rotating body; a moving mechanism moving the rubbing member from a position where the rubbing member is spaced apart from a surface of the heating rotating body to a position where the rubbing member rubs the heating rotating body; a first temperature sensor detecting the temperature of a first region of the heating rotating body through which the recording material having a conveyable minimum width in a width direction of the heating rotating body passes; a second temperature sensor detecting the temperature of a second region of the heating rotating body which is provided outside the first region of the heating rotating body and through which the recording material having a conveyable maximum size in the width direction of the heating rotating body passes; and a controller executing an operation of moving the rubbing member to the position where the rubbing member rubs the heating rotating body when a predetermined condition is satisfied, and when the difference between the temperature detected by the first temperature sensor and the temperature detected by the second temperature sensor is more than a predetermined value in a case that the predetermined condition is satisfied, the controller executing the operation with a delay until the difference becomes equal to or less than the predetermined value.

Still another object of the present invention is to provide an image heating apparatus including: a heating rotating body heating a toner image on a recording material at a nip portion; a rubbing member rubbing the heating rotating body; a moving mechanism moving the rubbing member from a position where the rubbing member is spaced apart from a surface of the heating rotating body to a position where the rubbing member rubs the heating rotating body; a first temperature sensor detecting the temperature of a first region of the heating rotating body through which the recording material having a conveyable minimum width passes; a second temperature sensor detecting the temperature of a second region of the heating rotating body which is provided outside the first region of the heating rotating body and through which the recording material having a conveyable maximum size passes; and a controller executing an operation of moving the rubbing member to the position where the rubbing member rubs the heating rotating body when the number of the recording materials with a predetermined width conveyed to the nip portion reaches a predetermined number, and when the difference between the temperature detected by the first temperature sensor and the temperature detected by the second temperature sensor is more than a predetermined value in a case that the recording material with the predetermined width conveyed to the nip portion reaches the predetermined number, the controller not executing the operation, and when the difference is equal to or less than the predetermined value in the case that the recording material with the predetermined width conveyed to the nip portion reaches the predetermined number, the controller executing the operation.

Further features of the present invention will become apparent from the following description of exemplary embodiments with reference to the attached drawings.

DESCRIPTION OF THE EMBODIMENTS

Embodiments of the present invention will now be described in detail in accordance with the accompanying drawings.

EXAMPLE 1

In this example, an image heating apparatus is provided as a fixing device for fixing an image, which is formed on a recording material with toner in an image forming apparatus using an electrophotographic system, onto the recording material.

Image Forming Apparatus

Figure 1:
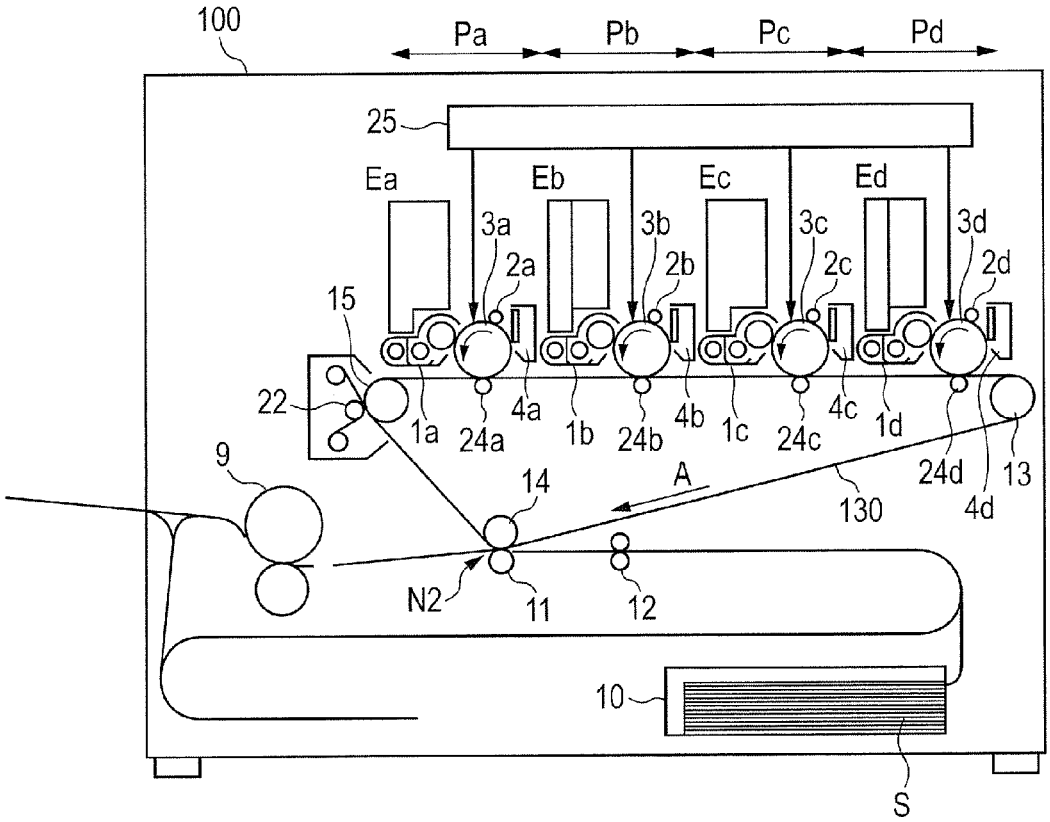
FIG. 1 is a schematic cross-sectional configuration diagram illustrating an image forming apparatus according to a first embodiment.

FIG. 1 is a schematic cross-sectional configuration diagram illustrating one example of an image forming apparatus provided with a fixing device according to this embodiment.

An image forming apparatus 100 of this embodiment is a full-color laser beam printer using an electrophotographic system. In the image forming apparatus, first, second, third, and fourth image forming portions Pa to Pd are provided in parallel. In the image forming portions Pa to Pd, toner images of different colors are formed through the processes of latent image formation, development, and transfer.

The image forming portions Pa to Pd are provided with drum type electrophotographic photosensitive members, that is, photosensitive drums 3*a* to 3*d* as dedicated image bearing members, respectively. Each of drums 3*a* to 3*d* is driven to rotate at a predetermined surface moving speed (peripheral speed) in a counter-clockwise direction shown by the arrow in the drawing. The toner images of the respective colors are formed on the drums 3*a* to 3*d* . An intermediate transfer belt 130 as an intermediate transfer body is installed adjacent to the drums 3*a* to 3*d* . The toner images of the respective colors formed on the respective drums 3*a* to 3*d* are primarily transferred onto the intermediate transfer belt 130 in the respective primary transfer portions and secondarily transferred onto a recording material S in a secondary transfer portion N2.

The recording material S, onto which the toner image is transferred, is conveyed to a fixing device 9, and the recording material S is heated and pressurized in the fixing device 9, whereby the toner image is fixed to the recording material S. After that, the recording material S as a recorded image is discharged outside the apparatus.

In the respective image forming portions Pa to Pd, charging rollers 2*a* to 2*d* as charging units and developing device 1*a* to 1*d* as developing units are respectively arranged around the respective drums 3*a* to 3*d*. Further, primary transfer rollers 24*a* to 24*d* as primary charging units and cleaners 4*a* to 4*d* as cleaning units are respectively provided around the drums 3*a* to 3*d*. A laser scanner 25 as an exposure unit provided with a light source device and a polygon mirror is installed above the drums 3*a* to 3*d* in the drawing.

The drums 3*a* to 3*d* are substantially uniformly charged by the charging rollers 2*a* to 2*d*. In the scanner 25, a laser beam emitted from the light source device is scanned by the rotating polygon mirror, and a luminous flux of the scanning light is deflected by a reflecting mirror and converged on generating lines of the drums 3*a* to 3*d* by a fθ lens. The drums 3*a* to 3*d* are exposed thus, whereby an electrostatic image (latent image) corresponding to an image signal is formed on each of the drums 3*a* to 3*d*.

The developing devices 1*a* to 1*d* are respectively filled with a predetermined amount of toner of yellow, magenta, cyan, and black as developers. The toner is suitably supplied to each of the developing devices 1*a* to 1*d* by each of supply devices Ea to Ed. The developing devices 1*a* to 1*d* respectively develop the latent images on the photosensitive drums 3*a* to 3*d* and make the latent images visible as yellow, magenta, cyan, and black toner images.

The belt 130 is suspended and tensed among three rollers including a driving roller 13, a secondary transfer opposing roller 14, and a tension roller 15 and is driven to rotate in the arrow A direction in the drawing by the driving roller 13 at the same surface moving speed (peripheral speed) as that in each of the drums 3*a* to 3*d*.

For example, in the full-color image formation, first, the yellow toner image of a first color is formed and borne on the drum 3*a*. The yellow toner image is transferred (primarily transferred) onto an outer periphery of the belt 130 in process of passing through a nip portion (primary transfer portion) formed by abutment of the drum 3*a* and the belt 130. At this time, a primary transfer bias is applied to the belt 130 through a primary transfer roller 24*a*, and the toner image is transferred onto the intermediate transfer belt 130 from the drum 3*a* by the electric field formed by the primary transfer bias and pressure.

Similarly, the magenta toner image of a second color, the cyan toner image of a third color, and the black toner image of a fourth color are sequentially superimposed and transferred onto the belt 130, and a synthetic color toner image corresponding to an intended color image is formed.

In the secondary transfer portion N2, a secondary transfer roller 11 as a secondary transfer unit is axially supported parallel to and opposite the secondary transfer opposing roller 14 with the belt 130 being disposed therebetween. An abutment nip portion between the belt 130 and the secondary transfer roller 11 is the secondary transfer portion N2. A predetermined secondary transfer bias is applied to the secondary transfer roller 11 by a secondary transfer bias power source.

In a recording material supply unit, the recording material S is supplied from a paper cassette 10 and passes through a resist roller 12, a pre-transfer guide (not shown) and the like. The recording material S is supplied, at a predetermined timing, to the nip portion (secondary transfer portion) N2 formed by abutment between the belt 130 and the secondary transfer roller 11. At the same time, the secondary transfer bias is applied from the secondary transfer bias power source to the secondary transfer roller 11. The synthetic color toner image superimposed and transferred onto the belt 130 is transferred (secondarily transferred) from the intermediate transfer body 130 to the recording material S by the secondary transfer bias.

Toner (transfer residual toner) remaining on the photosensitive drums 3*a* to 3*d* after the primary transfer is removed and collected by the cleaners 4*a* to 4*d*, respectively. The respective drums 3*a* to 3*d* are thus cleaned and subsequently provided for the next latent image formation. Toner and other foreign matter remaining on the intermediate transfer belt 130 are wiped by bringing a cleaning web (nonwoven fabric) 22 into abutment against the surface of the belt 130.

The recording material S, onto which the toner image is transferred in the secondary transfer portion N2, is introduced into the fixing device 9 (to be described in detail later). In the fixing device 9, heat and pressure are applied to the recording material S, whereby the toner image is fixed to recording material S.

Fixing Device

Figure 2A:
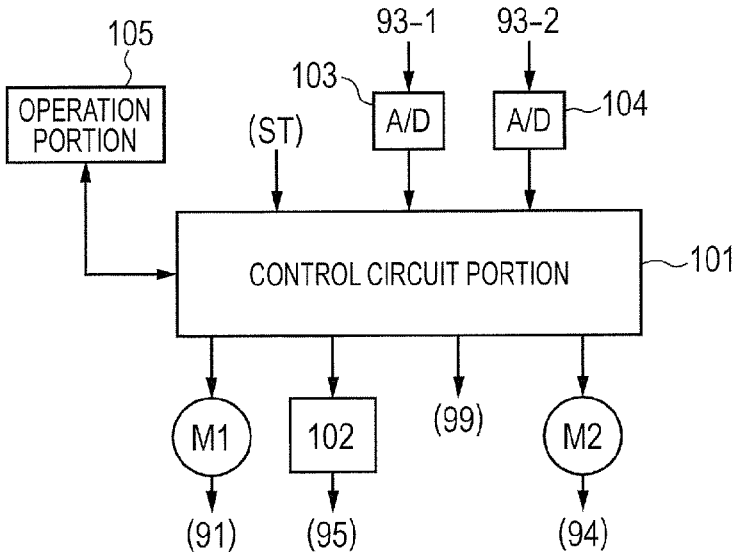
FIG. 2A is a block diagram illustrating a control system of a fixing device.
Figure 2B:
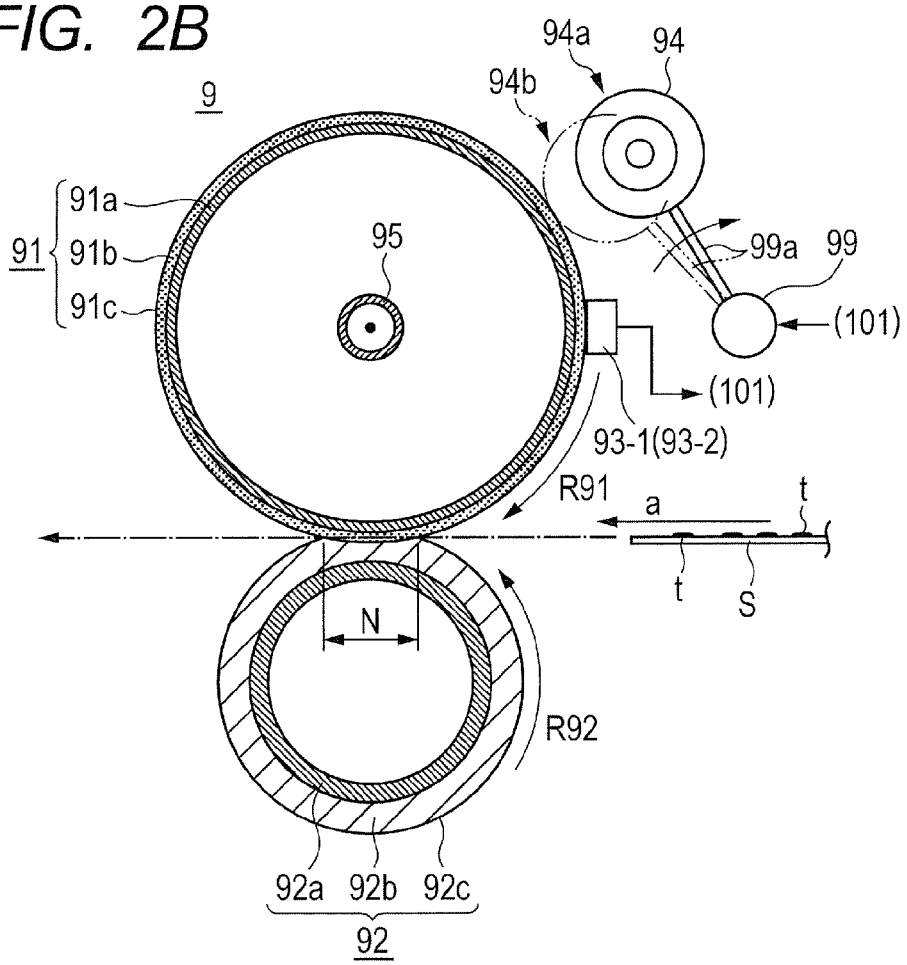
FIG. 2B is a crosswise sectional schematic diagram illustrating a main portion of the fixing device.
Figure 3:
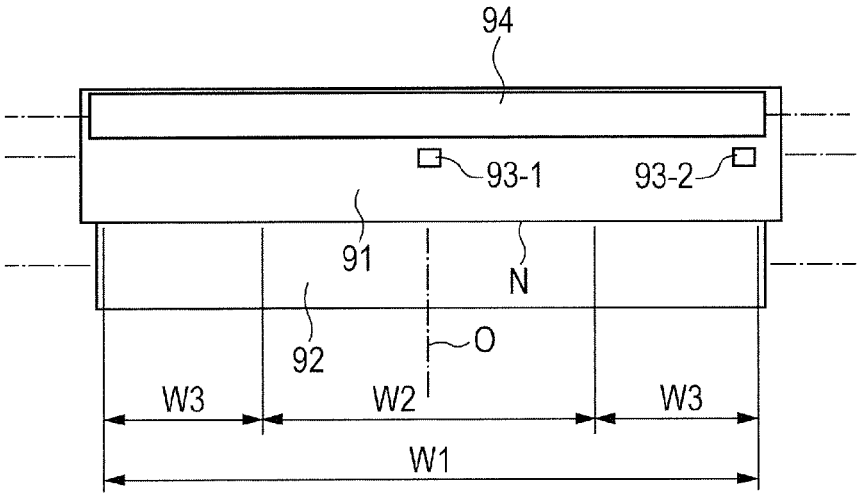
FIG. 3 is a front view illustrating a main portion of the fixing device.

FIG. 2A is a block diagram illustrating a control system of the fixing device 9 as an image heating apparatus, and FIG. 2B is a crosswise sectional schematic diagram illustrating a main portion of the fixing device 9. FIG. 3 is a front view illustrating a main portion of the fixing device 9. The fixing device 9 is a heat-roller-pair type and oilless type of fixing device mainly composed of a roller pair including a fixing roller 91 as a heating rotating body and a pressure roller 92 as a pressurizing rotating body (nip forming member). The fixing device 9 has a rubbing roller 94, which is a rotating body as a rubbing member, which recovers the surface nature of the fixing roller 91 by rubbing the surface of the fixing roller 91.

1) Fixing Roller 91

In the fixing roller 91, a silicone rubber having a degree of rubber hardness of 20 units (JIS-A 1 Kg load) and a thickness of 1.0 mm is formed as an elastic layer 91*b* on an outer periphery of a hollow cored bar 91*a* formed of Al having a thickness of 1 to 2 mm, for example, and an outer diameter ϕ of 68 mm. A fluororesin having a thickness of 50 μm as a release layer 91*c* is coated on the surface of the elastic layer 91*b*. The entire outer diameter ϕ of the fixing roller 91 is 70 mm.

In the fixing roller 91, a rubber layer 91*b* is formed on the hollow cored bar 91*a* in this embodiment. A PFA resin (4-ethylene fluoride resin), which has excellent releasing property of toner and is formed into a tube shape, is used as the surface layer 91*c*. In addition, a PFA resin (a copolymer of 4-ethylene fluoride resin and perfluoroalkoxy ethylene resin), PTFE (4-ethylene fluoride resin), or the like may be used as fluororesin for the surface layer 91*c*.

In the fixing roller 91, the width direction is a rotational axis line direction of the fixing roller 91. The fixing roller 91 is provided so that one and the other end sides of the fixing roller 91 are rotatably and axially supported and held through a bearing member between opposing side plates on one and the other end sides of a fixing device housing (not shown). The driving force of a fixing motor (fixing driving unit) M1 controlled by a control circuit portion (CPU: controller) 101 is transmitted to the fixing roller 91 through a power transmission mechanism (not shown), whereby the fixing roller 91 is driven to rotate at a predetermined speed in the clockwise direction of an arrow R91.

The control circuit portion 101 can perform various processing operations while controlling each section of the fixing device 9 using a RAM (not shown) as a work area based on a control program stored in a ROM (not shown). In this embodiment, the surface moving speed (peripheral speed) of the fixing roller 91 is 220 mm/sec. The peripheral speed of the fixing roller 91 corresponds to the process speed (image output speed) of the image forming apparatus 100.

In the hollow cored bar 91*a* of the fixing roller 91, a bar-shaped halogen heater 95 as a heating source (heating unit) long along a fixing roller width direction is provided at a position substantially corresponding to a position of the fixing roller rotational axis line. Electric power is supplied from a power source portion 102 controlled by the control circuit portion 101 to a heater 95, whereby the heater 95 generates heat. The heat generation distribution along the width direction of the heater 95 is substantially uniform. An inner peripheral surface of the cored bar 91*a* of the fixing roller 91 is heated by the heat generation of the heater 95, and an effective heating region along a longitudinal of the fixing roller is heated from the inside of the roller.

2) Pressure Roller 92

In the pressure roller 92, a silicone rubber having a degree of rubber hardness of 20 units (JIS-A 1 Kg load) and a thickness of 5.0 mm is formed as an elastic layer 92*b* on a hollow cored bar 92*a* formed of Al having a thickness of 2 to 3 mm, for example, and an outer diameter ϕ of 40 mm. A fluororesin having thickness of 30 μm as a release layer 92*c* is coated on the surface of the elastic layer 92*b*. The entire outer diameter ϕ of the pressure roller 92 is 50 mm.

The pressure roller 92 is provided parallel to the fixing roller 91 on the lower side of the fixing roller 91. One and the other end sides of the pressure roller 92 are rotatably and axially supported and held between opposing side plates on one and the other end sides of the fixing device housing through a bearing member. The pressure roller 92 is pressurized at a pressure of 800 N against the elasticity of the elastic layers 92*b* and 91*a* with respect to the fixing roller 91 by a pressurization mechanism (not shown). Consequently, a nip portion (image heating nip portion and fixing nip portion) N having a predetermined width in a recording material conveyance direction a is formed between the fixing roller 91 and the pressure roller 92. Namely, the pressure roller 92 functions as a nip forming member forming the heating nip portion along with the fixing roller. The pressure roller functions as the heating rotating body heating the recording material.

The fixing roller 91 is driven to rotate, whereby the pressure roller 92 is rotated in the counterclockwise direction of an arrow R 92 in accordance with the rotation of the fixing roller 91 by a frictional force between the pressure roller 92 and the fixing roller 91 in the nip portion N or the recording material S introduced into the nip portion N. The pressure roller 92 may be configured to be driven to rotate at a speed substantially corresponding to the peripheral speed of the fixing roller in a direction the same as the rotating direction of the fixing roller 91 in the nip portion N in cooperation with the rotation of the fixing roller 91.

3) Rubbing Roller 94

The rubbing roller 94 is rotatably held by a swing support member 99*a* of a pressurization mechanism 99 controlled by the control circuit portion 101. The pressurization mechanism 99 is a suitable swing operation mechanism, such as an electromagnetic solenoid mechanism, a cam-lever mechanism and the like swingably operating the support member 99*a* holding the rubbing roller 94.

Figure 4:
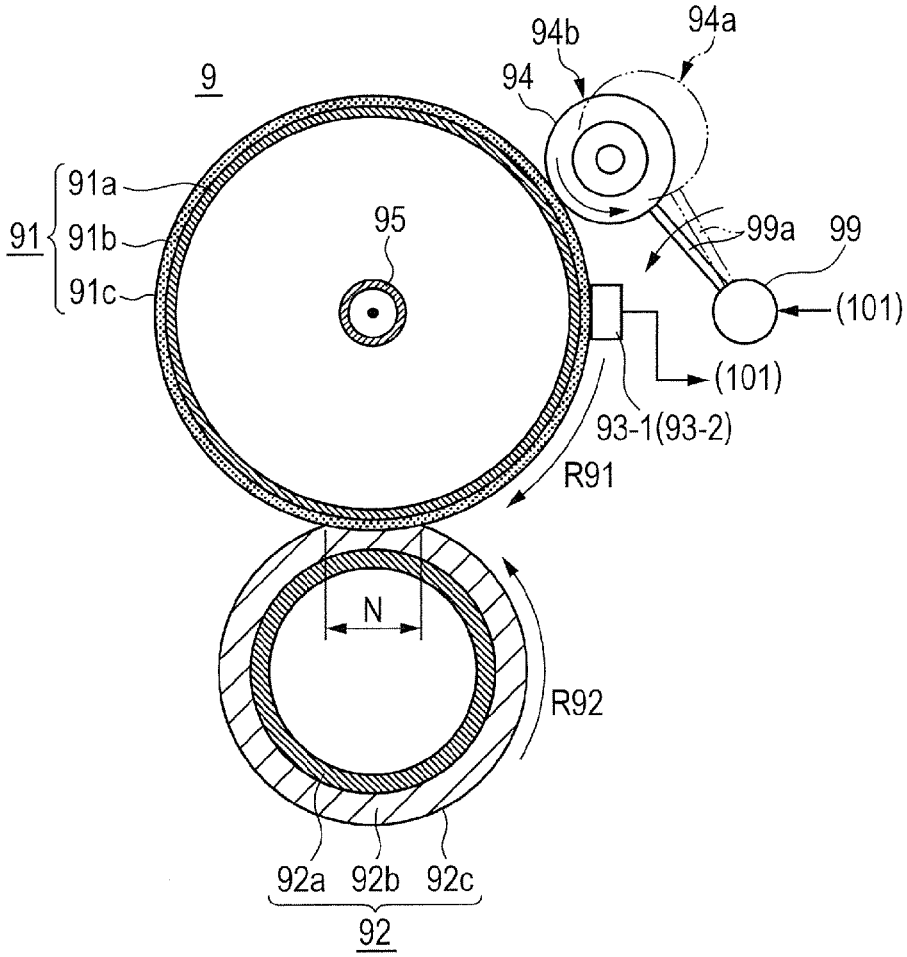
FIG. 4 is a view illustrating a state in which a rubbing roller is shifted to an acting position.

The rubbing roller 94 is selectively shifted to a non-acting position (detached state) 94*a* depicted by the solid line of FIG. 2B spaced apart from the fixing roller by the pressurization mechanism 99 and an acting position (attached state) 94*b* depicted by the solid line of FIG. 4 abutted against the fixing roller 91 by a predetermined pressing force. Namely, the rubbing roller is configured to enable to be in contact with and separated from the fixing roller 91.

The driving force of a rubbing roller drive motor M2 controlled by the control circuit portion 101 is transmitted to the rubbing roller 94 through a power transmission mechanism (not shown), and the rubbing roller is driven to rotate at a predetermined speed in a predetermine direction.

The rubbing roller 94 rubs the fixing roller 91 to form a large number of fine rubbing scuffs on a surface of the fixing roller 91 roughed by passing of the recording materials and an unroughed surface, whereby gloss streaks formed by a gloss difference on an image cannot be visually confirmed. The rubbing roller 94 forms the rubbing scuffs without substantially scraping away the surface of the fixing roller 91. The surface of the fixing roller 91 is roughed at a desired level using the rubbing roller 94, and the surface state is uniformed (homogenized), whereby the gloss difference on an image can be eliminated.

In this embodiment, in the rubbing roller 94, a surface layer of an SUS roller having an outer diameter ϕ of 20 mm is subjected to blast processing, and precipitation hardening treatment is applied to the surface layer. Consequently, since the rubbing roller 94 is hard and rough relative to a PFA tube serving as the surface layer (release layer) 91*c* of the fixing roller 91, the rubbing roller 94 has a capability of roughing the surface layer 91*c* by being pressurized against the fixing roller 91 with a pressurization force of 30N.

The surface roughness of the rubbing roller 94 is represented by average roughness Rz at ten points measured by a surface roughness measuring device SE-3400 manufactured by Kosaka Laboratory Ltd. under the measurement conditions of a feed speed of 0.5 mm/s, a cut off value of 0.8 mm, and a measurement length of 2.5 mm. The average roughness Rz at ten points can be 2 μm or more and 20 μm or less, and an average interval Sm of roughness can be 1 μm or more and 40 μm or less.

When the surface roughness Rz of the rubbing roller 94 is rougher than 20 μm, there occur adverse effects, including formation of a scuff having a depth affecting an actual image on the surface layer 91*c* of the fixing roller 91 and too much reduction in the releasing property easily causing fusion-bonding of toner. When Rz is less than 2 μm, the surface roughness of the fixing roller 91 cannot be changed to a desired value. When the Sm value is more than 40 μm, the number of concaveconvexes on the surface layer is small, and therefore, the capability of changing the surface roughness is weak as in the above case where Rz is low. Meanwhile, when the Sm value is less than 1 μm, deterioration in durability causes wear of the surface layer of the rubbing roller 94 when the surface roughness changing processing is repeated, so that the surface roughness is reduced.

The rubbing roller 94 is required to have a minute shape that can change the surface state of the fixing roller 91. An example of the surface layer satisfying this condition is a layer formed by coating the surface layer with fluoride coating containing a filler such as titanium or carbon.

As a base layer of the surface layer, a layer subjected to precipitation hardening treatment after blast processing for metal roller cored bar satisfies the above conditions. Alternatively, a layer in which the following abrasive grains are subjected to adhesion treatment by an adhesion layer and the like satisfy the above conditions. The abrasive grains are any one of aluminum oxide, aluminum hydroxide oxide, silicon oxide, cerium oxide, titanium oxide, zirconia, lithium silicate, silicon nitride, silicon carbide, iron oxide, chromium oxide, antimony oxide, diamond, and so on and a mixture thereof. The grain diameter of the abrasive grain can be approximately 2 μm to 20 μm due to the same reason as the surface state in the blast processing.

The surface layer of the rubbing roller 94 may be subjected to processing of enhancing the releasing property by being coated with fluororesin from above. In this case, a material having toner releasing property lower than that of the surface layer of the fixing roller 91 is selected. For example, FEP (fluorinated ethylene propylene resin) having toner releasing property lower than that of a PFA resin serving as the surface layer of the fixing roller 91 may be used. The fluororesin may contain a filler such as a titanium filler.

4) Temperature Detection Unit

In this embodiment, the recording materials S having various width sizes from small to large are passed through the fixing device 9 by a so-called center reference conveyance centering on the recording material width. The width size of the recording material S is a dimension in a direction perpendicular to a conveyance direction a of the recording material S in a recording material conveying path surface.

In FIG. 3, O is a center reference conveyance line (virtual line) of the recording material S. W1 is a width of a paper passing region (second region through which the recording material having the conveyable maximum size passes) of the recording material (large-size recording material) having the maximum width size that can be passed through the fixing device 9. In this embodiment, W1 corresponds to an A3 crosswise width (or an A4 longitudinal width).

W2 is a width of the paper passing region (first region through which the recording material having the conveyable minimum size passes) of the recording material (small-size recording material) having a width size smaller than that of the large-size recording material. W3 is a width of a paper non-passing region occurring in the nip portion N when the small-size recording material is passed and a difference region (W3=(W1−W2)/2) between a maximum size recording material width W1 and a small size recording material width W2.

The lengths of the fixing roller 91, the pressure roller 92, and the rubbing roller 94 are all larger than the width W1 of the paper passing region of the large-size recording material. A first thermistor 93-1 as a first temperature sensor and a second thermistor 93-2 as a second temperature sensor detect a surface temperature of the fixing roller 91.

The first thermistor 93-1 detects the temperature of the first region through which the recording material having the conveyable minimum size passes. Namely, the first thermistor 93-1 is provided at a central portion in the width direction of the fixing roller 91 (fixing roller portion substantially corresponding to the position of the center reference conveyance line O) so as to detect the surface temperature of the fixing roller portion as the paper passing region with respect to the recording materials having any width size from small to large.

The second thermistor 93-2 detects the temperature of the second region which is provided outside the first region and through which the recording material having the conveyable maximum size passes. Namely, the second thermistor 93-2 is provided at an end in the width direction of the fixing roller 91 (fixing roller portion corresponding to a position slightly inner than a boundary of the paper passing region W1 of the large-size recording material) so as to detect the surface temperature of the fixing roller portion as the paper non-passing region when the small-size recording material is passed.

The first thermistor 93-1 and the second thermistor 93-2 are arranged so as to be in contact elastically with the surface of the fixing roller 91 or closely face to the surface in a non-contact state. The temperatures (electrical information about temperatures) detected by the first thermistor 93-1 and the second thermistor 93-2 are input to the control circuit portion 101 through A/D converters 103 and 104.

4) Fixing Operation

In a normal state, the rubbing roller 94 is held at a non-acting position 94*a* (FIG. 2B) spaced apart from the fixing roller 91, and the rotation is stopped. The control circuit portion 101 turns on the fixing motor M1 based on an input of an image formation start signal ST. Consequently, the rotational driving of the fixing roller 91 is started, so that the pressure roller 92 rotates in accordance with the rotation. The control circuit portion 101 turns on the power source portion 102 and supplies electric power to the heater 95, whereby the fixing roller 91 is heated over the effective entire length region. The temperatures of the fixing roller 91 detected by the first thermistor 93-1 and the second thermistor 93-2 are input to the control circuit portion 101.

When the detected temperature input from the first thermistor 93-1 reaches a temperature corresponding to a predetermined image heating temperature (fixing temperature), a temperature control function portion of the control circuit portion 101 controls electric power supplied from the power source portion 102 to the heater 95 so that the temperature is maintained after that time. Namely, the fixing roller 91 is heated to a predetermined image heating temperature, which is 160 degrees C. in this embodiment, and subjected to temperature control at the temperature.

In the above state, the recording material S bearing an unfixed toner image t is introduced into the nip portion N of the fixing device 9 from an image forming mechanism portion side, nipped and conveyed. The fixing roller 91 is in contact with an image bearing surface of the recording material S. According to this constitution, the recording material S is heated and pressurized at the nip portion N, and the toner image t is fixed to the recording material S as a fixed image.

When the recording material S introduced into the fixing device 9 is the large-size recording material (maximum size recording material), the temperature of the fixing roller 91 detected by the second thermistor 93-2 is substantially the same as the temperature of the fixing roller 91 detected by the first thermistor 93-1. When the recording material S introduced into the fixing device 9 is the small-size recording material and the small-size recording materials are continuously passed, the temperature of a paper non-passing region W3 is increased by a so-called temperature increase phenomenon of the paper non-passing portion. Thus, the temperature of the fixing roller 91 detected by the second thermistor 93-2 is higher than the temperature of the fixing roller 91 detected by the first thermistor 93-1.

5) Homogenization Treatment Mode of Fixing Roller 91 (Refresh Mode)

In the homogenization treatment mode of the fixing roller 91, the rubbing operation of the fixing roller 91 performed by the rubbing roller 94 which is a rubbing member recovering the surface nature of the fixing roller 91 by rubbing the fixing roller 91 is executed.

In the normal state, the control circuit portion 101 controls the pressurization mechanism 99 so that the rubbing roller 94 is held at the non-acting position 94*a* (FIG. 2B) where the rubbing roller 94 is in non-contact with the fixing roller 91. When the refresh mode is executed, the control circuit portion 101 controls the pressurization mechanism 99 so that the rubbing roller 94 is shifted to the acting position 94*b* (FIG. 4) where the rubbing roller 94 is in contact with the fixing roller 91 by a predetermined pressing force. Further, the control circuit portion 101 turns on the motor M2 and drives the rubbing roller 94 to rotate. At a predetermined timing, the control circuit portion 101 pressurizes and drives to rotate the rubbing roller 94 with respect to the fixing roller 91 for a predetermined time to thereby make uniform the surface of the fixing roller 91.

The rubbing roller 94 is driven to rotate with a peripheral speed difference with respect to the fixing roller 91 by the motor M2 in a state of being shifted to the acting position 94*b* where the rubbing roller 94 is abutted against the fixing roller 91 by a predetermined pressing force. The rubbing roller 94 may be rotated so that the surface moving directions of the rollers 94 and 91 are either a forward direction or a reverse direction in an abutment portion (rubbing portion) between the rubbing roller 94 and the fixing roller 91. In this embodiment, in the abutment portion between the fixing roller 91 and the rubbing roller 94, the rubbing roller 94 is driven in the forward direction relative to the rotation of the fixing roller 91 at a surface speed twice the surface speed of the fixing roller 91 and rubs the fixing roller 91. In order to obtain the refresh effect reliably, the refresh operation is set so as to satisfy $7\times10^{-3}\leq(P/_{\pi}H\tan\theta)\cdot(|V-v|/V)\leq68\times10^{-3}$, when a load of a refresh roller on the heating rotating body is assumed to be P [N], the peripheral speed of the heating rotating body is assumed to be V [mm/sec], the peripheral speed of the refresh roller is assumed to be v [mm/sec], the microhardness of the heating rotating body is assumed to be H [GPa], and a half vertical angle of a protrusion of the heating rotating body surface is assumed to be θ [degrees].

The timing of pressurizing the rubbing roller 94 against the fixing roller 91 and driving the rubbing roller 94 to rotate is the time when scuffs or portions with different roughness occur on the fixing roller surface by the edge protrusion of the edge (edge in the width direction) of the recording material S or foreign matter, and an image failure, such as scuffs and gloss unevenness, occurs on an image.

In the above case, a user selects the homogenization treatment mode for the fixing roller 91 with a select key of an operation portion 105. The control circuit portion 101 executes the homogenization treatment mode for the fixing roller 91 based on an input of the mode select signal. Namely, the control circuit portion 101 turns on the motor M2 so as to drive to rotate the rubbing roller 94. The control circuit portion 101 controls the pressurization mechanism 99 and shifts the rubbing roller 94 to the acting position 94*b* where rubbing roller 94 is abutted against the fixing roller 91 by a predetermined pressing force. According to this constitution, the rubbing operation (homogenization treatment) of the rubbing roller 94 for the fixing roller 91 is executed for a predetermined time.

After a lapse of a predetermined time, the control circuit portion 101 controls the pressurization mechanism 99 to shift the rubbing roller 94 to the non-acting position 94*a* where the rubbing roller 94 is spaced apart from the fixing roller 91 and turn off the motor M2, and, thus, to terminate the homogenization treatment mode for the fixing roller 91.

The homogenization treatment mode for the fixing roller 91 may be periodically and automatically executed depending on the number of the recording materials passed through the apparatus.

Next, the features of the present invention will be described. When the unfixed toner image t is fixed to the recording material S, the fixing device 9 applies pressure and heat to the recording material S. At this time, the minute surface condition of the fixing roller 91 is transferred onto the surface of the fixed toner image. When the surface state on the fixing roller 91 is different, a difference of the surface state occurs on a toner image according to this fact, so that the gloss unevenness on an image occurs. This phenomenon becomes prominent on a coated paper having a high surface smoothness and a high gloss. Usually, the level of the phenomenon cannot be visually confirmed in fine paper and so on used in the office.

In general, a state in which reproducibility of a specular reflection light image is high is recognized as a high gloss, and a state in which the reproducibility is low or nothing is recognized as a low gloss. For example, when an image like silver halide photography is seen under fluorescent lamp illumination, not only the light of the fluorescent lamp is reflected, but the shape of the fluorescent lamp is reflected in the background. The gloss is recognized as the high gloss regardless of the user being conscious or not of this. This fact shows that the surface state of the photographic image is in a mirror surface state having small irregularities. Meanwhile, in the case of the low gloss, the opposite can be said. In the case of the low gloss, irregularities are large in the surface state of an image, the light of the fluorescent lamp is diffusely reflected, and the shape is not reflected in the background. Accordingly, there is a correlation between the irregularities in the surface state on the image and the gloss.

Particularly, when an image is fixed to a high gloss coated paper or the like requiring high image quality, a streak having a low gloss may be formed at a position corresponding to an edge protrusion portion of the fixing roller 91 (at a rough position), or a gloss difference occurs between the paper passing region and the paper non-passing region. Namely, gloss unevenness occurs on an image. Thus, the rubbing roller 94 is required to homogenize the entire longitudinal region of the fixing roller 91 so that the roughness is uniform with respect to scuffs on its surface, thereby eliminating the gloss unevenness due to the surface scuffs of the fixing roller 91.

Figure 5:
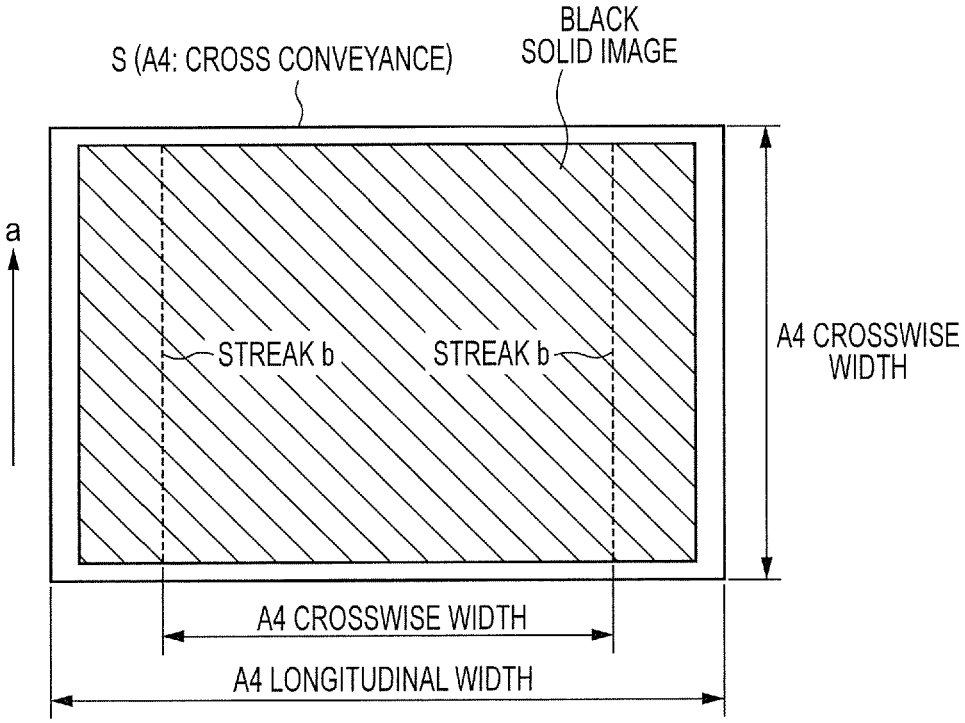
FIG. 5 is an explanatory view illustrating gloss streaks.

For example, several hundred A4 size papers are conveyed by the longitudinal conveyance and subjected to image formation. After that, when an A4 size coated paper is conveyed by the cross conveyance and a black solid image is formed on the entire surface of the paper, streaks b are formed in the A4 longitudinal width as shown in FIG. 5. Thus, it is effective to perform the homogenization treatment for the fixing roller 91 after passing of a predetermined number of recording materials having a small longitudinal width.

When the homogenization treatment for the fixing roller 91 is performed in the case that the temperature in the width direction of the fixing roller 91 is substantially uniform at a predetermined image heating temperature, which is 160 degrees C. in this embodiment, the surface roughness Rz is 0.5 to 1.0 μm. When the fixing operation is continuously applied to the recording materials having a small longitudinal width, heat is not drawn by the recording material in the paper non-passing region W3 in the fixing roller width direction, and therefore, the fixing roller surface temperature increases in comparison with the paper passing region W2.

Figure 6:
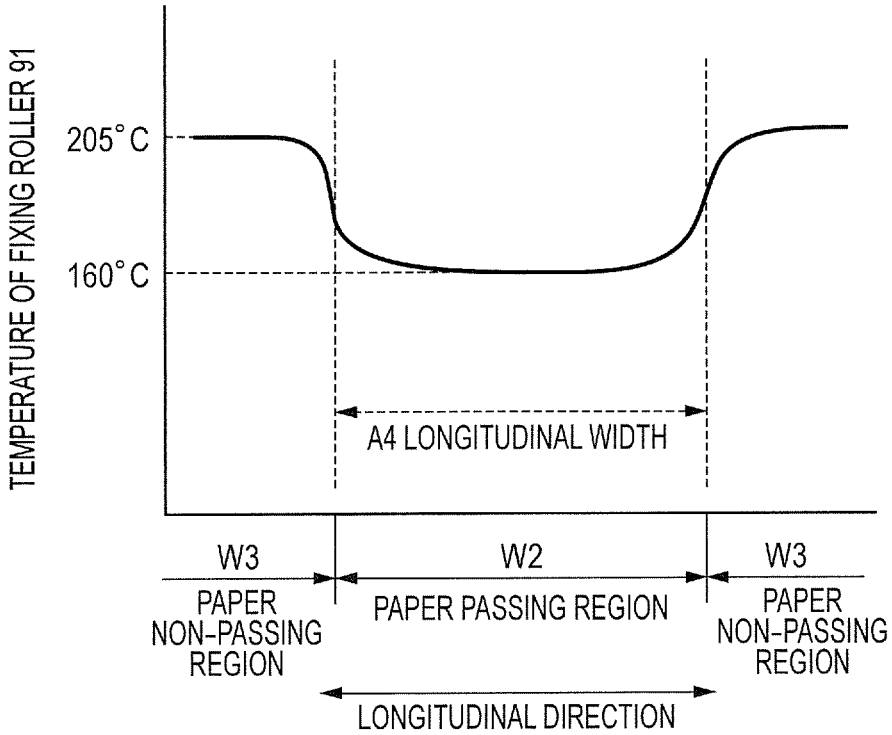
FIG. 6 is an explanatory view illustrating temperature increase of a paper non-passing portion of a fixing roller.

FIG. 6 shows a longitudinal temperature distribution of the fixing roller surface temperature after 500 recording materials S having an A4 size are continuously conveyed by the longitudinal conveyance in the fixing device 9 according to this embodiment. The temperature of the paper passing region W2 corresponding to the A4 size longitudinal width of the fixing roller 91 is adjusted by a temperature control function portion of the control circuit portion 101 so that the first thermistor 93-1 located at the longitudinal center of the fixing roller detects 160 degrees C. However, it can be shown that the temperature of the paper non-passing region W3 located outside the A4 size longitudinal width of the fixing roller 91 increases to 205 degrees C. (temperature increase in the paper non-passing portion).

Figure 7:
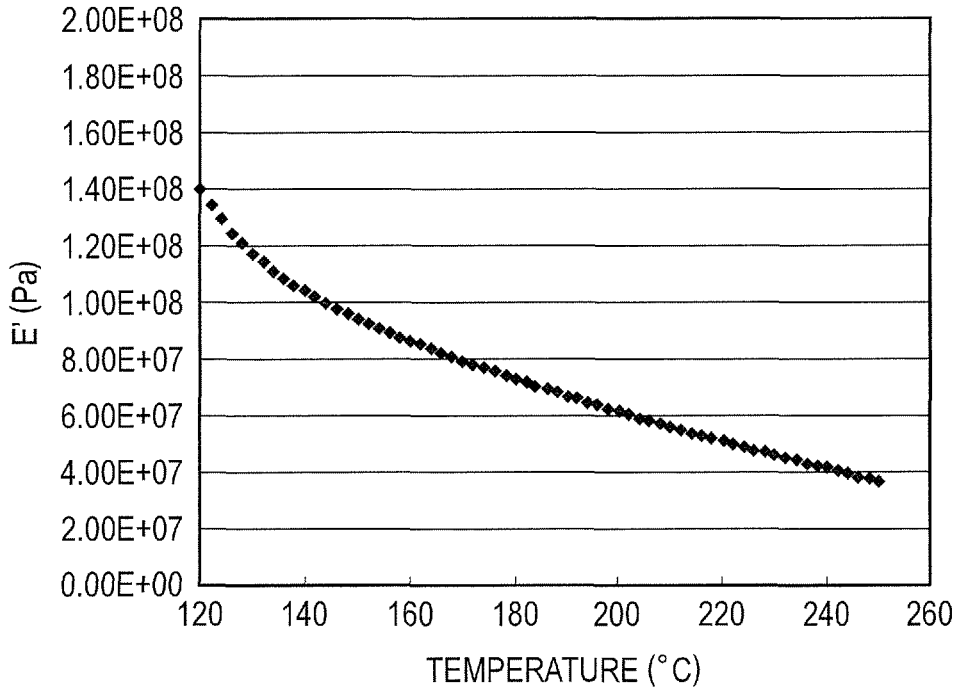
FIG. 7 is a viscosity characteristic diagram illustrating resin of a release layer.

Fluororesin (in this embodiment, PFA 350J manufactured by Du Pont-Mitsui Fluorochemicals Co., Ltd.) which is the surface layer (release layer) 91*c* of the fixing roller surface has a characteristic of reducing the viscosity with the increase of temperature as shown in FIG. 7. Thus, after the fixing operation for the recording material having a small longitudinal width is continuously performed, when the rubbing roller 94 is pressurized in order to perform the homogenization treatment in such a state that the temperature difference in the width direction of the fixing roller 91 is large, the following phenomenon occurs. Namely, the fixing roller surface in the paper non-passing region W3 is made significantly more rough than that in the paper passing region W2 due to a difference of the viscosity of fluororesin of the surface layer 91*c* occurring due to a difference of the fixing roller longitudinal temperature.

Thus, although the gloss streaks formed by the edge protrusion portion of the recording material are eliminated, it is found that the gloss unevenness may occur on an image between the paper passing region W2 and the paper non-passing region W3. Thus, in the present invention, the longitudinal temperature of the fixing roller 91 is controlled when the homogenization treatment is performed. Usually, although it is preferable to perform the homogenization treatment in such a state that the longitudinal temperature of the fixing roller 91 is substantially uniform, a waiting time is required until the temperature is substantially uniform from the above temperature difference.

According to the studies made by the present inventor, in the high gloss (approximately 50 at a 60 degree gloss level: handy gloss meter: PG-1M manufactured by Nippon Denshoku Industries Co., Ltd.) of a coated paper in such a state that the boundary is unclear, it is substantially difficult to visually confirm the difference when the gloss difference in an image surface is equal to or less than 5.

When the homogenization treatment is performed with the temperature difference between the paper passing region W2 and the paper non-passing region W3 as shown in FIG. 6, the surface roughness Rz of the paper passing region W2 of the fixing roller 91 is 0.5 to 1.0 μm, and meanwhile the surface roughness Rz of the high-temperature paper non-passing region W3 is 1.5 to 2.0 μm. The gloss difference at that time is approximately 8 and is a level in which the gloss difference can be recognized on an image.

When surfacing treatment is performed in such a state that the end temperature of the fixing roller 91 (temperature of the paper non-passing region W3) is 180 degrees C., the surface roughness Rz in the paper non-passing region W3 of the fixing roller 91 is 1.0 to 1.5 . The gloss at that time is approximately 5, and it is difficult to visually confirm the gloss difference between the paper non-passing region W3 and the paper passing region W2 on an image. Thus, in this embodiment, as conditions of performing the homogenization treatment, the temperature difference between a central portion which is the paper passing region of the fixing roller and an end portion which is the paper non-passing region is equal to or less than 20 degrees C. in such a state that the temperature of the central portion is adjusted to 160 degrees C.

Namely, the control circuit portion 101 executes the rubbing operation for the fixing roller 91 performed by the rubbing roller 94 under the following conditions (1) and (2): (1) a temperature TH1 detected by the first thermistor 93-1 is an image heating temperature; and (2) a temperature difference (difference) between the temperature (detected temperature) TH1 detected by the first thermistor 93-1 and a temperature (detected temperature) TH2 detected by the second thermistor 93-2 is equal to or less than a predetermined value.

The homogenization treatment is performed at the following timing as an example. Namely, in the control circuit portion 101, for example, when a recording material having a width size smaller than the A3 crosswise width (maximum paper passing width in this embodiment) is passed, the accumulative number of passed papers is counted for each width size. When the accumulative number of the recording materials having a certain width size exceeds a predetermined value (usually 100 to 1000 sheets, and for example, 500 sheets), the control circuit portion 101 shifts to the homogenization treatment mode for the fixing roller 91. In the homogenization treatment mode, the image forming operation of the image forming apparatus 100 is in a state of being temporarily stopped, and the control circuit portion 101 shifts to the homogenization treatment mode in such a state that the rotational driving of the fixing roller 91 and the temperature adjustment are continued in the fixing device 9.

Figure 8:
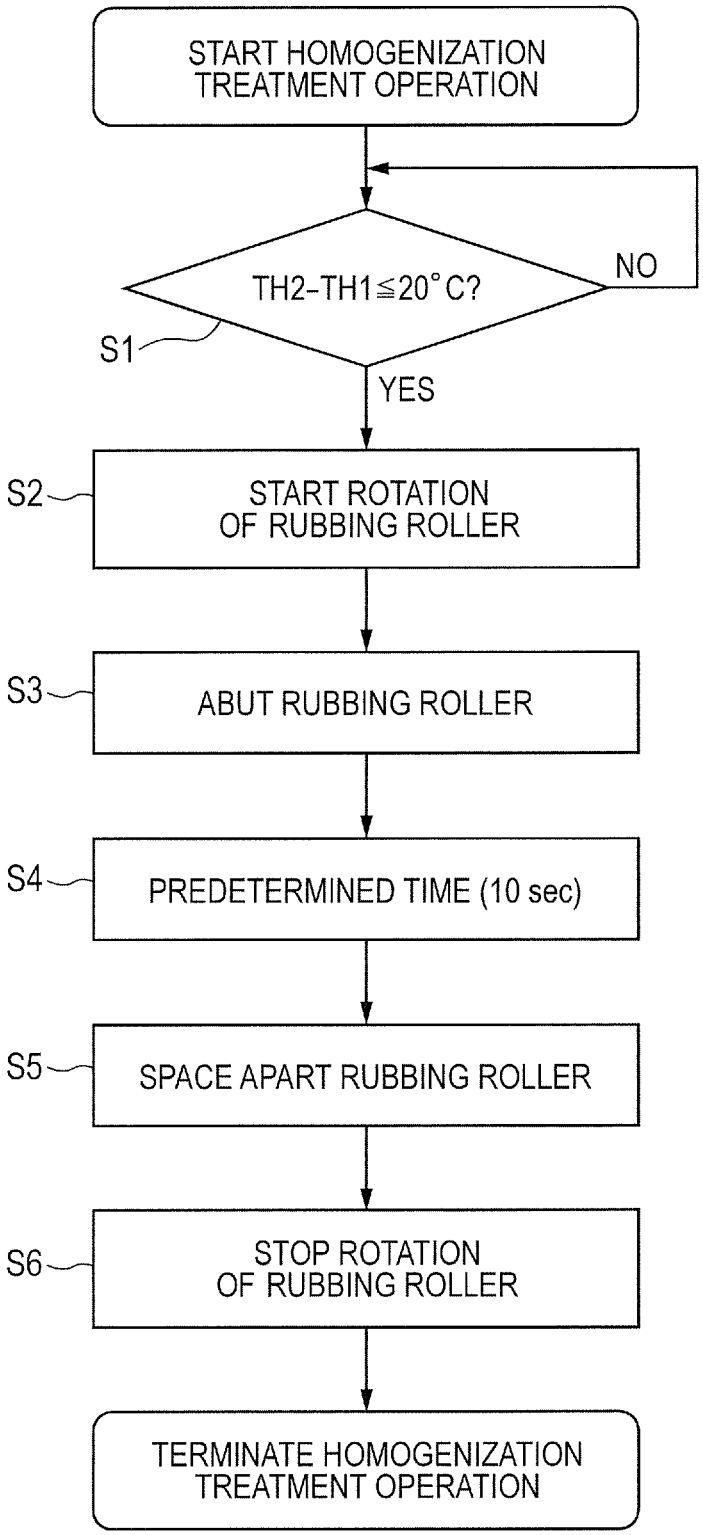
FIG. 8 is a flow chart illustrating a control flow in a homogenization treatment mode according to the first embodiment.

FIG. 8 is a flow chart illustrating a control flow in the homogenization treatment mode. When the homogenization treatment mode starts, the control circuit portion 101 performs the following determination in step S1. Namely, the control circuit portion 101 determines whether the temperature difference (difference: TH2−TH1) between the detected temperature TH1 input from the first thermistor 93-1 and the detected temperature TH2 input from the second thermistor 93-2 is equal to or less than a predetermined value. In this embodiment, the predetermined value is 20 degrees C. When the temperature difference is more than the predetermined value of 20 degrees C., the confirmation of the detected temperatures TH1 and TH2 and the determination of the temperature difference are repeated until the temperature difference equal to or less than the predetermined value of 20 degrees C. is detected. Namely, when the temperature difference is more than the predetermined value of 20 degrees C., the rubbing operation is not executed at a timing when the accumulative number exceeds a predetermined value. When the temperature difference is more than the predetermined value of 20 degrees C., the timing of executing the rubbing operation is delayed.

When it is determined that the temperature difference is equal to or less than the predetermined value of 20° C., the operation proceeds to step S2. In step S2,the control circuit portion 101 turns on the motor M2 and starts the rotation of the rubbing roller 94. Next, the operation proceeds to step S3, and the control circuit portion 101 controls the pressurization mechanism 99 to shift the rubbing roller 94 from the non-acting position 94*a* to the acting position 94*b* where the rubbing roller 94 is abutted against the fixing roller 91. Next, the operation proceeds to step S4, and a uniforming operation is performed for a predetermined time, which is 10 sec in this embodiment. Namely, the rubbing operation for the fixing roller 91 is executed by the rubbing roller 94 for 10 sec, and the fixing roller 91 is subjected to the homogenization treatment.

After a lapse of the predetermined time, the operation proceeds to step S5, the control circuit portion 101 controls the pressurization mechanism 99 to shift the rubbing roller 94 from the acting position 94*b* to the non-acting position 94*a* . Then, the operation proceeds to step S6, and the control circuit portion 101 turns off the motor M2 to terminate the rotation of the rubbing roller 94, and, thus, to terminate the homogenization treatment operation. After that, the control circuit portion 101 restarts the interrupted image forming operation.

In this embodiment, the recording materials having a small longitudinal width are continuously passed, the above control is performed, and surface scuff traces of the fixing roller 91 and the gloss unevenness are confirmed by the recording material having a large longitudinal width. More specifically, 500 A4 size papers (CS-814: basis weight of 80 g/m2, manufactured by Canon Inc.) are continuously conveyed by the longitudinal conveyance and subjected to the fixing operation, and then the above control is performed. Subsequently, the same A4 size paper is conveyed by the cross conveyance, and a solid image of blue as a second color is fixed to the entire surface. Consequently, it can be confirmed that a good fixed image with no image failure due to scuffs on the fixing roller surface and no gloss unevenness is obtained.

As described above, when the homogenization treatment for the surface roughness of the fixing roller is performed by the rubbing roller 94, the longitudinal temperature difference of the rubbing roller 94 is controlled within a predetermined temperature, whereby the fixing roller surface can be uniformly roughed. Consequently, the image failure due to scuffs on the fixing roller surface and the gloss unevenness due to unevenness of roughness of the fixing roller surface are prevented, and a good fixed image can be obtained. In this embodiment, as the conditions of executing the refresh operation, the number of the recording materials conveyed to a fixing nip reaches a predetermined number. Namely, the timing of executing the refresh operation is determined according to the number of the recording materials. However, the invention is not intended to be limited to this constitution. It may be constituted so that the timing of executing the refresh operation is determined according to the operating time when the heating device is operated. Namely, it may be constituted so that when the operating time reaches a predetermined time, the refresh operation is executed.

<Second Embodiment>

The feature of this embodiment is to add a temperature uniforming member (heat homogenizing unit) to smooth a longitudinal temperature difference of a fixing roller. By executing the second embodiment, it is intended to reduce down time which occurs when fixing operation is performed in the case that the recording materials having different sizes are stored. Hereinafter, the fixing device in this embodiment will be described. Description of the portions common to those in the first embodiment will be omitted.

Figure 9:
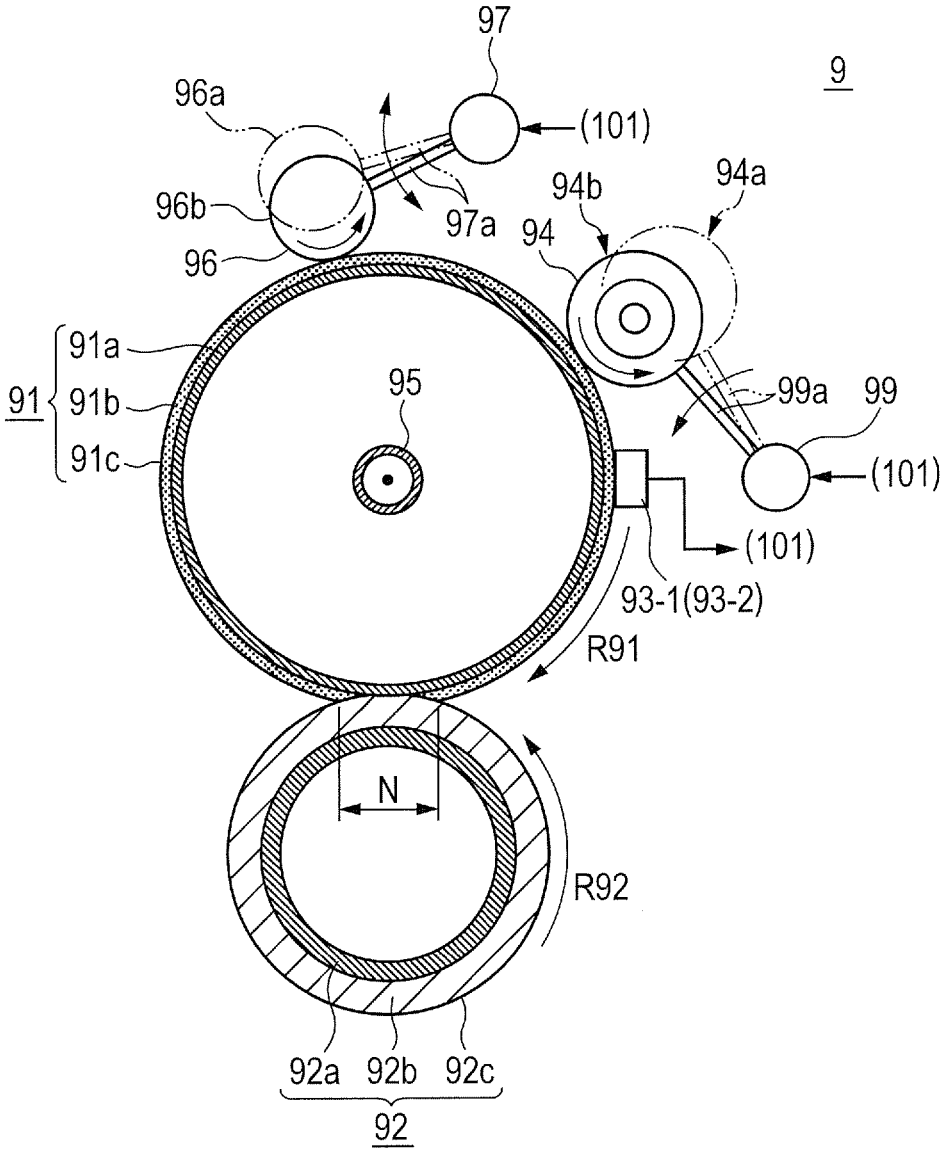
FIG. 9 is a crosswise sectional schematic diagram illustrating a main portion of a fixing device according to a second embodiment.

FIG. 9 is a crosswise sectional schematic diagram of a main portion of a fixing device 9 in this embodiment. The fixing device 9 in FIG. 2B of the first embodiment is further provided with a heat homogenizing roller 96 as the temperature uniforming member in order to smooth a longitudinal temperature difference of a fixing roller 91. Other configurations of the fixing device are similar to the configurations of the fixing device of the first embodiment.

In the case that the longitudinal temperature difference is large when the homogenization treatment for improving scuffs of the fixing roller surface is performed, the heat homogenizing roller 96 is installed for reducing the time of smoothing the temperature difference. Thus, as the material of the heat homogenizing roller 96, a high thermal conductivity material is preferably used, more preferably metal or a metal pipe enclosed with a liquid in the inner surface. The heat homogenizing roller 96 has a length dimension corresponding to an effective heating width of the fixing roller 91. In this embodiment, the heat homogenizing roller 96 has a roller having an outer diameter ϕ of 20 mm and formed of aluminum. Moreover, in order to prevent adhesion of surface stains, the heat homogenizing roller 96 is coated with fluororesin as a surface layer so that the thickness is 20 μm.

The heat homogenizing roller 96 is rotatably held by a swing support member 97*a* of a pressurization mechanism 97 controlled by a control circuit portion 101. As with the pressurization mechanism 99 of the rubbing roller 94, the pressurization mechanism 97 is a suitable swing operation mechanism, such as an electromagnetic solenoid mechanism or a cam-lever mechanism, swingably operating a support member 97*a* which holds the heat homogenizing roller 96.

The heat homogenizing roller 96 is selectively shifted to a non-acting position (spaced-apart state) 96*a* depicted by the two-dot chain line, where the heat homogenizing roller 96 is spaced apart from the fixing roller 91 by the pressurization mechanism 97 controlled by the control circuit portion 101 and an acting position (abutted state) 96*b* depicted by the solid line, where the heat homogenizing roller 96 is abutted against the fixing roller 91 by a predetermined pressing force. Namely, the heat homogenizing roller 96 is configured to enable to be in contact with and separated from the fixing roller 91.

The heat homogenizing roller 96 is usually held at the non-acting position 96*a* where the heat homogenizing roller 96 is spaced apart from the fixing roller 91. The heat homogenizing roller 96 is shifted to the acting position 96*b* to be in contact with the fixing roller 91 along the longitudinal of the fixing roller 91, and, thus, to be rotated in accordance with the rotation of the fixing roller 91, whereby the heat homogenizing roller 96 homogenizes the longitudinal temperature of the surface of the fixing roller.

In the first embodiment, when the homogenization treatment is performed after the continuous fixing operation for a large amount of the recording materials having a small longitudinal width, if the temperature difference of the longitudinal of the fixing roller 91 is large, the waiting time is required until the temperature difference goes down within a predetermined temperature difference (step S1 of FIG. 8).

Thus, in this embodiment, in order to reduce the waiting time, when it is determined that the longitudinal temperature difference of the fixing roller 91 is more than a predetermined value, the heat homogenizing roller 96 is shifted to the acting position 96*b* , and the temperature difference in the fixing roller is homogenized.

Figure 10:
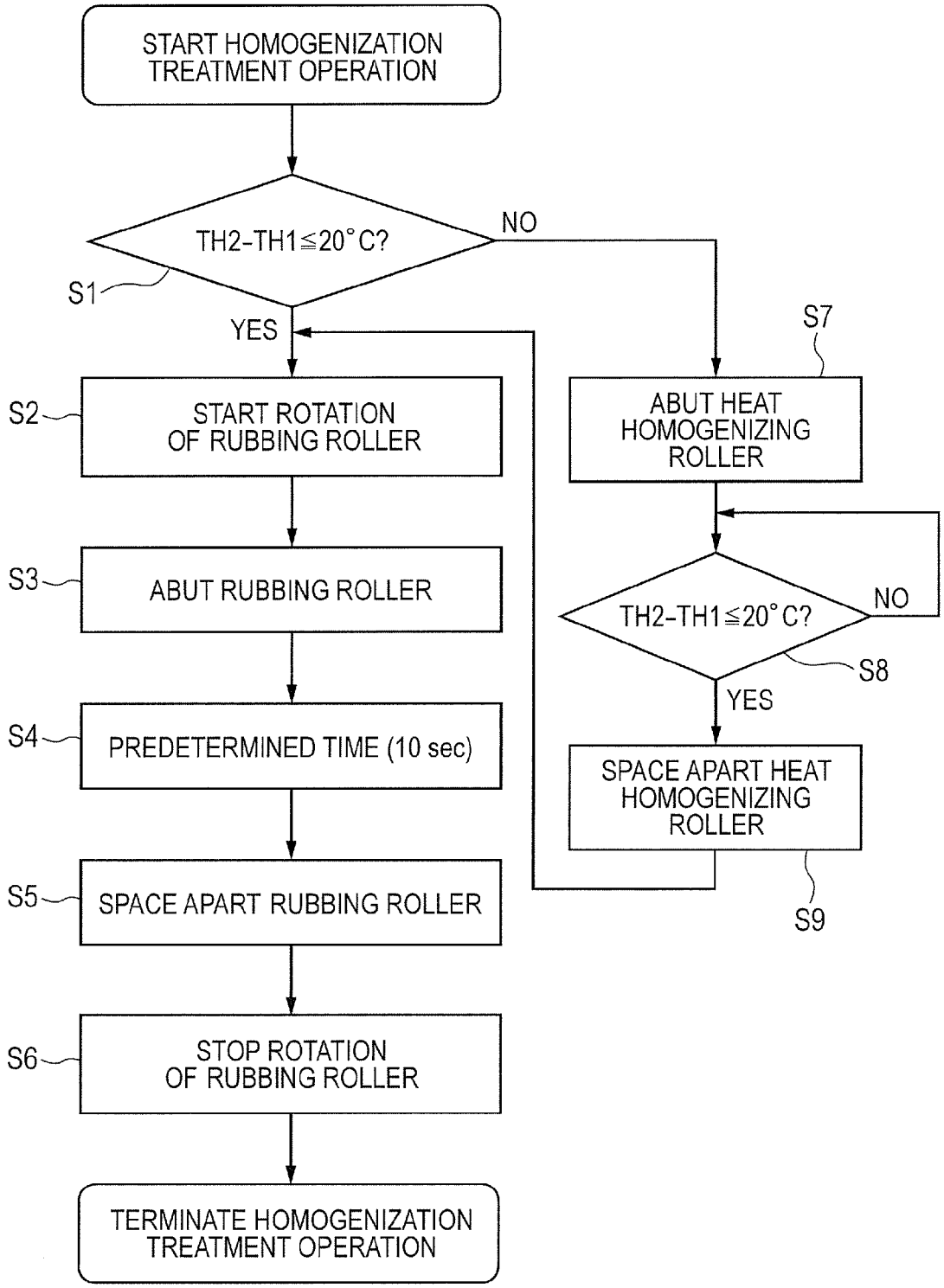
FIG. 10 is a flow chart illustrating a control flow in a homogenization treatment mode according to the second embodiment.

FIG. 10 is a flow chart showing a control flow in the homogenization treatment mode in this embodiment. When the homogenization treatment mode is started, in step S1, the control circuit portion 101 determines the temperature difference (TH2−TH1) between a detected temperature TH1 input from a first thermistor 93-1 and a detected temperature TH2 input from a second thermistor 93-2 as with the first embodiment. When the temperature difference is more than a predetermined value of 20° C., the operation proceeds to step S7. In step S7, the control circuit portion 101 controls the pressurization mechanism 97 to shift the heat homogenizing roller 96 from the non-acting position 96*a* to the acting position 96*a* where the heat homogenizing roller 96 is abutted against the fixing roller 91.

In the above state, the control circuit portion 101 waits until the temperature difference between the detected temperature TH1 input from the first thermistor 93-1 and the detected temperature TH2 input from the second thermistor 93-2 becomes equal to or less than a predetermined value (20° C.) (step S8). This waiting time is reduced in comparison with the first embodiment because the temperature difference in the fixing roller 91 is more actively homogenized by the heat homogenizing roller 96.

In step S8, when it is determined that the temperature difference (TH2−TH1) is equal to or less than the predetermined value (20° C.), the operation proceeds to step S9. The control circuit portion 101 controls the pressurization mechanism 97 to shift the heat homogenizing roller 96 from the acting position 96*b* to the non-acting position 96*a*.

Afterward, as with the first embodiment, the homogenization treatment for the fixing roller 91 is performed by the rubbing roller 94 in steps S2 to S6. After that, the control circuit portion 101 restarts the interrupted image forming operation.

Also in this embodiment, it is confirmed by the paper-passing test as in the case of the first embodiment that a good fixed image with no image failure due to scuffs on the fixing roller surface and no gloss unevenness is obtained. Although in the first embodiment a time of about sec is required from the start of the homogenization treatment operation to the start of the rotation of the rubbing roller 94, in the constitution of the second embodiment the waiting time can be reduced to approximately 20 sec.

As described above, when the homogenization treatment operation for the surface roughness of the fixing roller is performed by the rubbing roller 94, the longitudinal temperature difference in the fixing roller 91 is controlled within the predetermined temperature, whereby the fixing roller surface can be uniformly roughed. Consequently, an image failure due to scuffs on the fixing roller surface and the gloss unevenness due to the roughness unevenness of the fixing roller surface is prevented, so that a good fixed image can be obtained.

In this embodiment, the heating rotating body is a roller. However, the invention is not intended to be limited to this constitution. As the heating rotating body, a flexible endless belt, which is suspended and tensed among a plurality of support members and circulated and moved, may be used.

In this embodiment, the rubbing member abuts against the fixing roller 91. However, the invention is not intended to be limited to this constitution. The rubbing member may abut against the pressure roller 92.

In this embodiment, the fixing roller 91 is heated by an internal heating method. However, the invention is not intended to be limited to this constitution. The fixing roller 91 may be heated from outside by an external heating method. Alternatively, the fixing roller 91 may be heated internally or externally by an electromagnetic heating method.

In this embodiment, a roller is used as the pressure roller 92 forming the nip portion N together with the fixing roller 91.

However, the invention is not intended to be limited to this constitution. A rotatably endless belt may be used as a pressure member forming the nip portion N. Alternatively, a pressure member in the form of an irrotational member (such as a pressure pad) having a small friction coefficient of a surface (abutment surface against the heating rotating body 91 or the recording material S) may be used. Moreover, the pressure member 92 may be heated.

In this embodiment, the recording material S is conveyed to the apparatus by a center reference. However, the invention is not intended to be limited to this constitution. An apparatus configuration in which the recording material is conveyed by a one side reference based on a side portion on one side in the width direction of the recording material may be employed.

In this embodiment, the image heating apparatus is used as a fixing device for heating and fixing an unfixed image, which is formed on a recording material, as a fixed image. Of course, the invention is not intended to be limited to this constitution.

The image heating apparatus can be used as a heat treatment device which adjusts a surface texture of an image, including heating and pressurizing the image (fixed image or semi-fixed image) temporarily fixed onto a recording material to enhance the glossiness.

In this embodiment, the rubbing roller 94 is used as the heat homogenizing unit. However, the invention is not intended to be limited to this constitution. A fan may be used as the heat homogenizing unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions This application claims the benefit of Japanese Patent Application No. 2011-256008, filed Nov. 24, 2011, which is hereby incorporated by reference herein in its entirety.

What is claimed is:

1. An image heating apparatus, comprising:

a heating rotating body heating a toner image on a recording material at a nip portion;

a rubbing member rubbing the heating rotating body;

a moving mechanism moving the rubbing member from a position where the rubbing member is spaced apart from a surface of the heating rotating body to a position where the rubbing member rubs the heating rotating body;

a first temperature sensor detecting a temperature of a first region of the heating rotating body through which the recording material having a conveyable minimum width in a width direction of the heating rotating body passes;

a second temperature sensor detecting a temperature of a second region of the heating rotating body which is provided outside the first region of the heating rotating body and through which the recording material having a conveyable maximum size in the width direction of the heating rotating body passes;

a controller executing an operation of moving the rubbing member to the position where the rubbing member rubs the heating rotating body when a number of the recording materials with a predetermined width conveyed to the nip portion reaches a predetermined number, and when a difference between the temperature of the first region detected by the first temperature sensor and the temperature of the second region detected by the second temperature sensor is more than a predetermined value in a case that the number of the recording materials with the predetermined width conveyed to the nip portion reaches the predetermined number, the controller executing the operation with a delay until the difference becomes equal to or less than a predetermined value; and a heat homogenizing unit smoothing the temperature distribution of the heating rotating body, wherein, when the difference is more than the predetermined value in the case that the number of the recording materials with the predetermined width conveyed to the nip portion reaches the predetermined number, the heat homogenizing unit is operated.

2. The image heating apparatus according to claim 1, wherein, when the difference is equal to or less than the predetermined value in the case that the number of the recording materials with the predetermined width conveyed to the nip portion reaches the predetermined number, the controller executes the operation without the delay.

3. The image heating apparatus according to claim 1, wherein the heating rotating body includes a surface layer formed of fluororesin.

4. The image heating apparatus according to claim 1, wherein the heat homogenizing unit is a metal member configured to abut against and be spaced apart from the heating rotating body, and wherein the controller brings the metal member into abutment against the heating rotating body when the difference is more than the predetermined value in the case that the number of the recording materials with the predetermined width conveyed to the nip portion reaches the predetermined number.

5. An image heating apparatus comprising:

a heating rotating body heating a toner image on a recording material at a nip portion;

a rubbing member rubbing the heating rotating body;

a moving mechanism moving the rubbing member from a position where the rubbing member is spaced apart from a surface of the heating rotating body to a position where the rubbing member rubs the heating rotating body;

a first temperature sensor detecting a temperature of a first region of the heating rotating body through which the recording material having a conveyable minimum width in a width direction of the heating rotating body passes;

a second temperature sensor detecting a temperature of a second region of the heating rotating body which is provided outside the first region of the heating rotating body and through which the recording material having a conveyable maximum size in the width direction of the heating rotating body passes;

a controller executing an operation of moving the rubbing member to the position where the rubbing member rubs the heating rotating body when a predetermined condition is satisfied, and when a difference between the temperature of the first region detected by the first temperature sensor and the temperature of the second region detected by the second temperature sensor is more than a predetermined value in a case that the predetermined condition is satisfied, the controller executing the operation with a delay until the difference becomes equal to or less than the predetermined value; and a heat homogenizing unit smoothing a temperature distribution of the heating rotating body, wherein, when the difference is more than the predetermined value in the case that the predetermined condition is satisfied, the heat homogenizing unit is operated.

6. The image heating apparatus according to claim 5, wherein, when the difference is equal to or less than the predetermined value in the case that the predetermined condition is satisfied, the controller executes the operation without the delay.

7. The image heating apparatus according to claim 5, wherein the heating rotating body includes a surface layer formed of fluororesin.

8. The image heating apparatus according to claim 5, wherein the heat homogenizing unit is a metal member configured to abut against and be spaced apart from the heating rotating body, and wherein the controller brings the metal member into abutment against the heating rotating body when the difference is more than the predetermined value in the case that the predetermined condition is satisfied.

9. An image heating apparatus comprising:

first and second rotatable members configured to form a nip portion therebetween for heating a toner image on a recording material;

a rubbing rotatable member configured to rub an outer surface of the first rotatable member in a rubbing operation;

a moving mechanism configured to move the rubbing rotatable member between an operating position in which the rubbing rotatable member is contacted to the first rotatable member and a stand-by position in which the rubbing rotatable member is spaced from the first rotatable member;

a first detector configured to detect a temperature of a first region of the first rotatable member;

a second detector configured to detect a temperature of a second region, which is different from the first region in a longitudinal direction of the first rotatable member, of the first rotatable member; and a controller configured to control whether an execution of the rubbing operation is to be permitted or not, based on a temperature difference between the temperature of the first region detected by the first detector and the temperature of the second region detected by the second detector, wherein in a case that the temperature difference is equal to or less than a predetermined temperature, the controller permits the execution of the rubbing operation, and wherein in a case that the temperature difference is larger than the predetermined temperature, the controller does not permit the execution of the rubbing operation.

10. The image heating apparatus according to claim 9, wherein the first region is a region in which the first rotatable member is contacted to a minimum recording material having a minimum width in the longitudinal direction usable in the apparatus, and the second region is a region in which the first rotatable member is contacted to a maximum recording material having a maximum width in the longitudinal direction usable in the apparatus.

11. The image heating apparatus according to claim 9, wherein in a case that the controller does not permit the execution of the rubbing operation, the controller delays the execution of the rubbing operation until the temperature difference becomes to the predetermined temperature.

12. The image heating apparatus according to claim 9, further comprising a counter configured to count the number of the recording materials passed through the nip portion, wherein when a counted value of the counter is equal to or larger than a predetermined value, the controller permits the execution of the rubbing operation in a case that the temperature difference is equal to or less than the predetermined temperature, and the controller does not permit the execution of the rubbing operation in a case that the temperature difference is larger than the predetermined temperature.

13. The image heating apparatus according to claim 12, wherein in a case that the controller does not permit the execution of the rubbing operation, the controller delays the execution of the rubbing operation until the temperature difference becomes to the predetermined temperature.

14. The image heating apparatus according to claim 9, further comprising an operating portion configured to be operated by an operator to designate the execution of the rubbing operation, wherein when the execution of the rubbing operation is designated via the operating portion, the controller permits the execution of the rubbing operation in a case that the temperature difference is equal to or less than the predetermined temperature, and the controller does not permit the execution of the rubbing operation in a case that the temperature difference is larger than the predetermined temperature.

15. The image heating apparatus according to claim 14, wherein in a case that the controller does not permit the execution of the rubbing operation, the controller delays the execution of the rubbing operation until the temperature difference becomes to the predetermined temperature.

16. The image heating apparatus according to claim 9, wherein the rubbing rotatable member rubs in the rubbing operation so that a surface roughness Rz of the first rotatable member is not less than 0.5 μm and not more than 2.0 μm.

17. The image heating apparatus according to claim 9, wherein the rubbing rotatable member is a roller having polishing particles thereon.

18. The image heating apparatus according to claim 17, wherein a surface roughness Rz of the rubbing rotatable member is not less than 2 μm and not more than 20 μm.

19. The image heating apparatus according to claim 9, wherein the controller makes the rubbing rotatable member move to the stand-by position from the operating position by the moving mechanism when the rubbing operation is finished.

20. The image heating An apparatus according to claim 9, wherein the first rotatable member is disposed at a side so as to contact to the toner image on the recording material.

* * * * *